US005979516A

United States Patent [19]

Grant

[11] Patent Number: 5,979,516

[45] Date of Patent: Nov. 9, 1999

[54] FUNNEL

[76] Inventor: Edward M. Grant, 178 Rockaway Pkwy., Apt. 2L, Brooklyn, N.Y. 11212

[21] Appl. No.: 09/116,002

[22] Filed: Jul. 15, 1998

[51] Int. Cl.[6] ..... B65B 1/04

[52] U.S. Cl. ..... 141/331; 141/114; 141/98; 141/337; 141/340; 184/1.5

[58] Field of Search ..... 141/114, 98, 331–345; 184/1.5, 106

[56] References Cited

U.S. PATENT DOCUMENTS

| | | | |
|---|---|---|---|
| 4,592,448 | 6/1986 | Morris | 184/1.5 |
| 4,901,776 | 2/1990 | Attinello . | |
| 5,074,343 | 12/1991 | Tyree, Jr. . | |
| 5,168,908 | 12/1992 | Boyum . | |
| 5,259,426 | 11/1993 | Burleigh et al. | 141/331 |
| 5,381,839 | 1/1995 | Dowd | 141/331 |
| 5,535,793 | 7/1996 | Tantre | 141/337 |
| 5,803,140 | 9/1998 | Jodian | 141/98 |
| 5,819,819 | 10/1998 | Stanley | 141/114 |

FOREIGN PATENT DOCUMENTS 081128A 2/1982 United Kingdom .

*Primary Examiner*—Steven O. Douglas
*Attorney, Agent, or Firm*—Jordan and Hamburg LLP

[57] ABSTRACT

A funneling apparatus for selectively directing the flow of materials out of a container. The funneling apparatus has a funnel with an inlet having a device for detachably securing the funnel to the container.

20 Claims, 1 Drawing Sheet

SECTION A-A

FUNNEL

BACKGROUND OF THE INVENTION

The present invention relates to an apparatus for enabling selective direction of the flow of fluids and/or other matter. In particular, the invention is advantageously used to direct the flow of fluids from a container which is being emptied. More specifically, the inventive apparatus is used to selectively direct the flow of fluids from a type of container having an obstruction, such as a plug, therein which must be removed prior to emptying the same.

A primary example of the problem addressed by the inventive apparatus is that encountered when changing the oil in an automobile. The oil pan of an automobile has a drain hole equipped with a drain plug which must be removed when changing the oil. Unfortunately, when a mechanic removes the drain plug, the oil immediately begins to flow out from the oil pan and often spills on the mechanics hands, clothing or onto the floor. This problem is especially vexatious when the oil is hot, as it generally is in a drive-through oil change establishment.

In contrast to the present invention, which is concerned with directing the flow of fluids from a container that is being emptied, the prior art has been concerned with directing the flow of fluids when filling a container. For example, funnels have been used to minimize spills when filling containers.

Improvements in these funnels have generally concentrated on minimizing spills when filling a container. This problem has been addressed by modifying the funnel so that it can more easily be determined when the container is full. Examples of such modifications include U.S. Pat. No. 5,168,908 to Boyum (a funnel with a flange at the nozzle to maintain the nozzle at a spaced relationship from the container opening to permit viewing of the level of the liquid), U.S. Pat. No. 5,074,343 to Tyree, Jr. (a funnel-shaped filling unit with a displacer extending into the container being filled to prevent it from actually being overfilled), and U.S. Pat. No. 4,901,776 to Attinello (a funnel with a float to indicate when the container is full).

Spills can also be minimized by permitting the escape of air when using a funnel to fill a container. GB 2 081 128 discloses one such funnel which includes a filter in the conical portion thereof.

An object of the invention is to provide an apparatus for enabling selective direction of the flow of fluids. A further object of the invention is to provide an apparatus for permitting removal of a plug from a container, to enable emptying of the container, while selectively directing the flow of fluid emptying out of the container.

SUMMARY OF THE INVENTION

The present invention is a funneling apparatus which directs or funnels fluids out of a container being emptied, while permitting removal of any plug used to hold fluid in the container. The funneling apparatus has a funnel with an inlet The funneling apparatus can be of any size or shape depending on the shape of the container being emptied. The inlet can be adapted to be fitted around the outlet of a container to be emptied.

Additional objects and advantages of the claimed invention will become apparent from the detailed description of the invention together with the figures.

DETAILED DESCRIPTION OF THE INVENTION

Figure 1:
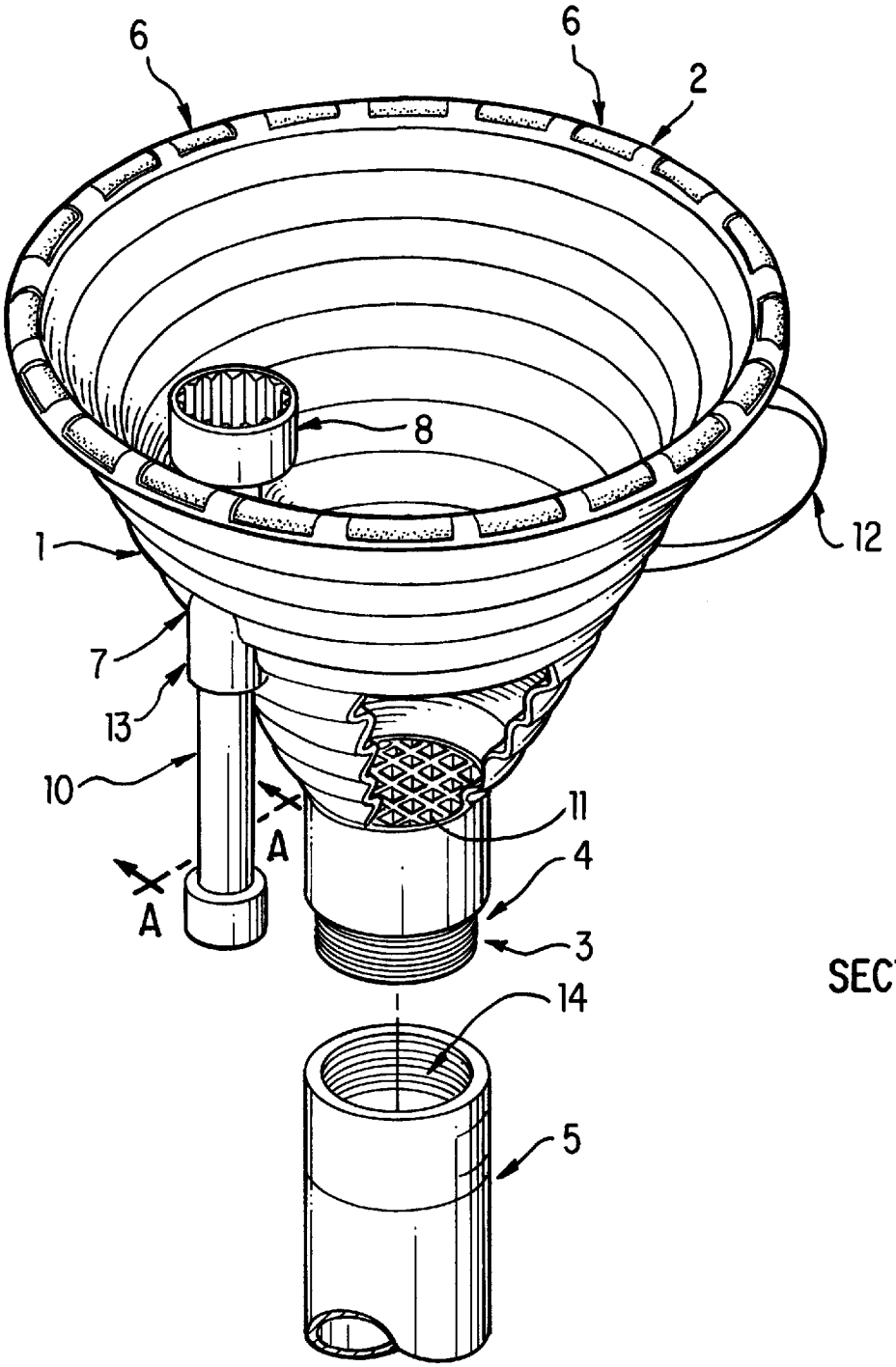
FIG. 1 is a perspective view of a funnel of the present invention and a drain pipe for attachment to the funnel.
Figure 2:
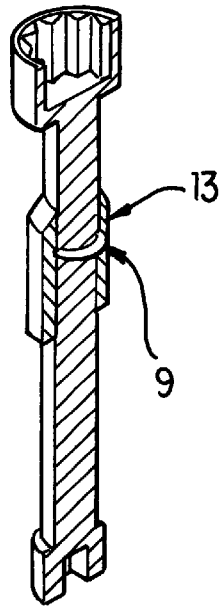
FIG. 2 is a cross-sectional view of a socket wrench taken at A—A of FIG. 1.

The inventive funnel 1 shown in FIG. 1 includes optional features in addition to essential ones. It is only essential that the funnel 1 have an inlet 2. It is preferable the funnel 1 have an outlet 3, which may include threads 4 for easy attachment to an oil pan, not shown, or a drain pipe 5 provided with complementary threads 14. Without the outlet 3, the funnel 1 operates as a receptacle for the material being emptied from the container, as well as a funneling apparatus.

The perimeter or mouth of the inlet 2 is preferably detachably secured to the container being emptied. It can be secured by any means, for example, by adhesive, nails, screws, nuts and bolts, staples, clips, etc., not shown. A preferred manner of securing the inlet 2 to a surface of a magnetic material is by one or more magnets 6. The funnel 1 can more easily direct the flow of fluids from a container being emptied, without spillage, by securing the inlet 2 to the surface of the container being emptied. The magnets 6 can be made of any magnetic material. It is desirable to use magnetized slivers of cast iron for the magnets 6 to enable the funnel 1 to adhere firmly to any ferrous surface. For example, magnets 6 can be permanent magnets of an alloy of neodymium, iron and boron, such as the type of magnets referred to as MQ3 magnets or sold under the trademark MAGNEQUENCH.

The inventive funnel 1 is advantageously used when emptying an oil pan of a motor vehicle, such as an automobile. When oil from the oil pan is drained, the funnel 1 can be placed beneath the drain hole to selectively direct the oil being emptied. This is especially desirable, since the oil being drained can be directed away from a mechanic and into an appropriate container. Attachment of the inlet 2 to the bottom of the oil pan, by one or more magnets 6, for example, can further avoid undesirable spillage of the oil.

These advantages of the funnel 1 are applicable to any container being drained where it is desirable to select the direction of the flow of fluids, or other matter, therefrom. In the case where the container being emptied has a plug or other obstruction which must be removed or opened prior to emptying the container, it is preferred that the funnel 1 have an opening 7 through which one can reach into the funnel and open the container, for example by removing the plug. It is thus possible to have the funnel in place prior to opening the container, because the opening 7 permits opening of the container even when the funnel 1 is covering the opening. It is preferable that the opening 7 have a cover (not shown).

The advantages of the funnel 1 having an opening 7 are apparent in the example where the funnel 1 is used to selectively direct the flow of oil from a draining oil pan. The draining of an oil pan normally requires the use of a socket wrench 8 to remove the plug therefrom. When thc funnel 1 has an opening 7, the socket wrench 8 can be inserted into the opening 7 to remove the plug. Thus, funnel 1 can be secured to the bottom of the oil pan prior to removing the plug therefrom to avoid any spillage when the plug is removed. Preferably, the socket wrench 8 is inserted through the opening 7 and seated on the plug prior to adjusting the placement of the funnel 1 around the drain hole of the container.

It is preferable the socket wrench 8 include a drive extension 10. The drive extension 10 should be of a length sufficient to enable use of the socket wrench 8 through the opening 7. Preferably, the drive extension 10 is from about 5 to about 8 inches long.

It is also preferable that the socket wrench 8 include an o-ring 9 and/or the funnel 1 include a sleeve 13 to prevent fluid entering the funnel 1 from draining out of the opening 7 and from coating the portion of the drive extension 10 of the socket wrench 8, which is located outside of the funnel 1. The o-ring 9 and/or sleeve 13 desirably reinforce the seal of the opening 7, so that even if the funnel 1 is flexed, fluid is not likely to exit the funnel 1 through the opening 7. The o-ring 9 and the sleeve 13 can be made of any suitable material, such as, for example, rubber, plastic, metal, etc. Preferably, the o-ring 9 and the sleeve 13 are made of rubber and are replaceable.

The funnel 1 preferably includes a screen 11 at its outlet 3. Advantageously, the screen 11 catches any plug removed from the container to prevent the plug from exiting the funnel through the outlet 3 and being lost in the fluid emptied from the container.

Though the funnel 1 can be of any shape, the preferred shape is conical. When the funnel 1 is conical, the inlet 2 is in its "bowl" or conical shaped portion and the outlet 3 is at its nozzle or neck portion. The mouth of the inlet 2 is preferably wider than that of the outlet 3 and can be of any shape, such as, rectangular, square, round, oval, hexagonal, etc. It is preferably oval in shape so that it can most easily be secured around a drain hole at the edge of a container.

The size of the mouth of the inlet 2 is not limited and should be appropriately modified to fit the container it is being used to direct liquid out of. Most containers can be fitted with an inlet mouth ranging in diameter from about 3" to about 10". However, both smaller and larger diameters may be required depending on the container being emptied and the size and location of the drain hole. The mouth of an average inlet has a diameter of about 5". The inlet 2 is preferably able to create a seal at an angle anywhere from about 90° to about 180° about a container. For example, if the container is the oil pan of a motor vehicle positioned horizontally, the aforementioned 90° would be an orientation of the funnel 1 in which the axis of the funnel 1 is vertical and the aforementioned 180° would be an orientation of the funnel 1 in which the axis of the funnel 1 is horizontal. Obviously, the angle has to be less than 180° in order for all the oil to flow through and out of the funnel 1. However, if at least the "bowl" of the funnel 1 is flexible, the funnel 1 may be flexed somewhat to change its orientation without breaking the seal.

The outlet 3 is preferably smaller than the inlet 2. The diameter of the outlet 3 is not limited to a particular dimension. For example, it may range from about 0.5 to about 4 inches and preferably range from about 1 to about 2 inches. It is generally desirable for the outlet 3 to be about 1 inch in diameter.

Preferably, the "bowl" of funnel 1 is made of a flexible material, such as, for example, a flexible polymeric material, i.e., a rubber or a plastic. A preferred rubber is neoprene rubber, because it is highly resistant to heat, water, oxidation, grease and oil. It also bonds well to both metals and plastics. To enhance the flexibility of the funnel 1, the walls of the "bowl" thereof may be of a bellows-like or corrugated configuration, as shown in FIG. 1.

The outlet 3 and drain pipe 5 can be made of the same material as the funnel 1 or any other suitable material. Preferably, the outlet 3 and drain pipe 5 are made of a rigid polymeric material, for example, a plastic such as, for example, acrylonitrile butadiene styrene polymer ("A B S").

The drain pipe 5 can be of any length suitable for selectively directing the flow of fluids from the funnel 1. For example, the drain pipe 5 can be from about 5 to about 10 inches long.

A handle 12 is preferably attached to the funnel 1, for example near the inlet 2, to enable easy positioning of the funnel 1.

The funnel 1 of the present invention is specifically designed to enable selective direction of materials being emptied from a container. However, the funnel 1 is also capable of being used to fill a container by placing its outlet 3 at the opening of a container and pouring the desired material through the inlet 2, out of the outlet 3 and into the container.

The present invention is subject to various changes and modifications understood by one with ordinary skill in the art, which are not limited by the description herein and which are contemplated by the scope of the appended claims.

What is claimed is:

1. A funneling apparatus comprising a funnel, the funnel having a conical shape with an inlet end and an outlet end, said inlet end having a larger diameter than said outlet end, said funnel and said inlet end being a flexible polymeric material and said outlet end being a rigid polymeric material, and at least one magnet being positioned at the inlet end for magnetically and detachably securing the inlet to a desired surface of a receptacle containing a fluid to be drained, the funnel having a conical wall and an additional opening in the conical wall, said additional opening being sealable and enabling access to the surface of the receptacle.

2. The funneling apparatus of claim 1, wherein the funnel further comprises a screen at the outlet, to filter the fluid exiting the outlet, and a sealing means at the additional opening to prevent fluid entering the inlet of the funnel from exiting the additional opening.

3. The combination of the funneling apparatus of claim 1 and a socket wrench part comprising a socket and a socket holder adapted to receive a socket wrench, wherein the socket wrench part is insertable through the additional opening in the conical wall, the socket holder being elongated and having an elongate axis, the axis of the socket holder being parallel to the axis of the conical shaped funnel, and, when the socket wrench part is inserted through the additional opening, the socket of the socket wrench part is inside the funnel and at least a part of the socket holder extends outside the funnel parallel to the axis of the conical shaped funnel to enable engagement by a user.

4. The funneling apparatus of claim 3, wherein the socket holder is encircled by an o-ring.

5. The funneling apparatus of claim 1, wherein the outlet is provided with threads for securing the outlet to another object.

6. The funneling apparatus of claim 5, wherein the other object is a drain pipe.

7. The funneling apparatus of claim 1, wherein the funnel further comprises a handle proximate the inlet for easily securing the inlet to the desired surface of the receptacle.

8. A funneling apparatus comprising a funnel and a socket holder for holding a socket, the funnel having a conical wall with an inlet end, an outlet end and an additional opening in the conical wall, said funnel and said inlet end being a flexible polymeric material and said outlet end being a rigid polymeric material, the inlet having means for detachably securing the inlet to a desired surface of a receptacle containing a fluid to be drained, the socket holder being insertable through the additional opening in the conical wall, the socket holder having a socket access end and an elongated socket wrench access end, the socket holder being elongated and having an elongate axis, the axis of the socket holder being parallel to the axis of the conical wall, and, when the socket holder is inserted through the additional opening, the socket access end of the socket holder is inside the funnel and the socket wrench access end of the socket holder extends outside the funnel parallel to the axis of the conical shaped funnel to enable engagement by a user.

9. The funneling apparatus of claim 8, wherein the means for detachably securing the inlet to a desired surface is at least one of magnet and adhesive.

10. A funneling apparatus comprising a funnel, the funnel having a conical wall with an inlet end and an outlet end, said funnel and said inlet end being a flexible polymeric material and said outlet end being a rigid polymeric material, said inlet end having a larger diameter than said outlet end, the funnel having a sealable socket wrench access in the conical wall, which is adapted to receive a socket wrench, and at least one magnet being positioned at the inlet end for magnetically and detachably securing the inlet to a desired surface of a receptacle containing a fluid to be drained.

11. A funneling apparatus comprising a funnel, the funnel having a conical shape with an inlet end and an outlet end, said inlet end having a larger diameter than said outlet end, said inlet end including corrugated walls for enhancing the flexibility of the inlet, and at least one magnet being positioned at the inlet end for magnetically and detachably securing the inlet to a desired surface of a receptacle containing a fluid to be drained, the funnel having a conical wall and an additional opening in the conical wall, said additional opening being sealable and enabling access to the surface of the receptacle.

12. The funneling apparatus of claim 11, wherein the funnel further comprises a screen at the outlet, to filter the fluid exiting the outlet, and a sealing means at the additional opening to prevent fluid entering the inlet of the funnel from exiting the additional opening.

13. The combination of the funneling apparatus of claim 11 and a socket wrench part comprising a socket and a socket holder adapted to receive a socket wrench, wherein the socket wrench part is insertable through the additional opening in the conical wall, the socket holder being elongated and having an elongate axis, the axis of the socket holder being parallel to the axis of the conical shaped funnel, and, when the socket wrench part is inserted through the additional opening, the socket of the socket wrench part is inside the funnel and at least a part of the socket holder extends outside the funnel parallel to the axis of the conical shaped funnel to enable engagement by a user.

14. The funneling apparatus of claim 13 wherein the socket holder is encircled by an o-ring.

15. The funneling apparatus of claim 11, wherein the outlet is provided with threads for securing the outlet to another object.

16. The funneling apparatus of claim 15, wherein the other object is a drain pipe.

17. The funneling apparatus of claim 11, wherein the funnel further comprises a handle proximate the inlet for easily securing the inlet to the desired surface of the receptacle.

18. A funneling apparatus comprising a funnel and a socket holder for holding a socket, the funnel having a conical wall with an inlet end, an outlet end and an additional opening in the conical wall, the inlet including corrugated walls for enhancing the flexibility of the inlet, the inlet having means for detachably securing the inlet to a desired surface of a receptacle containing a fluid to be drained, the socket holder being insertable through the additional opening in the conical wall, the socket holder having a socket access end and an elongated socket wrench access end, the socket holder being elongated and having an elongate axis, the axis of the socket holder being parallel to the axis of the conical wall, and, when the socket holder is inserted through the additional opening, the socket access end of the socket holder is inside the funnel and the socket wrench access end of the socket holder extends outside the funnel parallel to the axis of the conical shaped funnel to enable engagement by a user.

19. The funneling apparatus of claim 18, wherein the means for detachably securing the inlet to a desired surface is at least one of magnets and adhesive.

20. A funneling apparatus comprising a funnel, the funnel having a conical wall with an inlet end and an outlet end, said inlet end having a larger diameter than said outlet end, said inlet end including corrugated walls for enhancing the flexibility of the inlet, the funnel having a sealable socket wrench access in the conical wall, which is adapted to receive a socket wrench, and at least one magnet being positioned at the inlet end for magnetically and detachably securing the inlet to a desired surface of a receptacle containing a fluid to be drained.

* * * * *